US009781990B2

(12) United States Patent
Oh

(10) Patent No.: US 9,781,990 B2
(45) Date of Patent: Oct. 10, 2017

(54) SLIDE TYPE LIPSTICK CASE

(71) Applicant: AMOREPACIFIC CORPORATION, Seoul (KR)

(72) Inventor: Ju Won Oh, Seoul (KR)

(73) Assignee: AMOREPACIFIC CORPORATION, Cheonggyecheon-Ro, Jung-Gu, Seoul (KR)

( * ) Notice: Subject to any disclaimer, the term of this patent is extended or adjusted under 35 U.S.C. 154(b) by 0 days.

(21) Appl. No.: 15/039,840

(22) PCT Filed: May 8, 2015

(86) PCT No.: PCT/KR2015/004591

§ 371 (c)(1),
(2) Date: May 26, 2016

(87) PCT Pub. No.: WO2015/170910

PCT Pub. Date: Nov. 12, 2015

(65) Prior Publication Data

US 2016/0374456 A1 Dec. 29, 2016

(30) Foreign Application Priority Data

May 9, 2014 (KR) ..... 20-2014-0003612 U

(51) Int. Cl.
*B43K 21/00* (2006.01)
*A45D 40/02* (2006.01)
*A45D 40/12* (2006.01)

(52) U.S. Cl.
CPC ..... *A45D 40/02* (2013.01); *A45D 40/023* (2013.01); *A45D 40/026* (2013.01); *A45D 40/12* (2013.01)

(58) Field of Classification Search
CPC .... A45D 40/02; A45D 40/023; A45D 40/026; A45D 40/12
(Continued)

(56) References Cited

U.S. PATENT DOCUMENTS 3,810,700 A * 5/1974 Bryan ..... A45D 40/026 401/59
4,367,965 A * 1/1983 Speitel ..... A45D 40/026 401/107
(Continued)

FOREIGN PATENT DOCUMENTS

JP 2001-145516 A 5/2001
KR 10-1983-0003895 A 6/1983
(Continued)

*Primary Examiner* — Jennifer C Chiang
(74) *Attorney, Agent, or Firm* — East West Law Group; Heedong Chae

(57) ABSTRACT

A slide type lipstick case prevents a cosmetic stick from sliding down when using the lipstick case, while maintaining soft sensitivity when operating the lipstick case, by: forming a button and a button guide slit into which the button is inserted on the outer peripheral surface of an outer case; connecting a slide member for moving the cosmetic stick upwards and downwards, to a rib of the button and the lower end of a cosmetic stick holder; forming control protrusions on the upper and lower side of the button guide slit; and forming friction protrusions, at the rib of the button, for interfering the upward and downward movements of the button by fractionizing button guide slit.

3 Claims, 7 Drawing Sheets

(58) Field of Classification Search
USPC ..... 401/82
See application file for complete search history.

(56) References Cited

U.S. PATENT DOCUMENTS

| | | | | |
|---|---|---|---|---|
| 6,237,613 | B1 * | 5/2001 | Finnigan | A45D 40/026 132/318 |
| 6,902,333 | B2 * | 6/2005 | Miyagawa | A45D 40/02 401/181 |
| 2014/0219703 | A1 * | 8/2014 | Kim | A45D 40/023 401/59 |

FOREIGN PATENT DOCUMENTS

| | | | |
|---|---|---|---|
| KR | 10-1999-0028553 | A | 12/1999 |
| KR | 10-2013-0003633 | A | 1/2013 |
| KR | 10-1222088 | B | 3/2013 |

* cited by examiner

Prior Art

Prior Art

SLIDE TYPE LIPSTICK CASE

CROSS-REFERENCE TO RELATED APPLICATION

This application claims the benefit of Korean Application No. 20-2014-0003612, filed on May 9, 2014 with the Korean Intellectual Property Office, the disclosure of which is incorporated herein by reference.

TECHNICAL FIELD

The present invention relates to a slide-type lipstick container, and more particularly to a slide-type lipstick container in which a. button and a button guide slit, into which the button is fitted, are formed in an outer circumferential surface of an external case, a slide member, which moves a lipstick up and down, is coupled to ribs of the button and a lower end of a lipstick holder, studs are formed at upper and lower portions of the button guide slit, and friction protrusions are formed on the ribs of the button so that the friction protrusions make friction with the button guide slit to control the vertical movement of the button, thereby preventing the lipstick from being pushed down when the lipstick container is used and allowing the lipstick container to smoothly operate when the lipstick container operates.

BACKGROUND ART

Cosmetics may be classified into various types of products depending on the use purposes, the applied parts, or ingredients of contents, and the shape of the cosmetics. Typically, the cosmetics are divided into basic, color, and functional cosmetics.

Among the color cosmetics, a lipstick may be suggested as a kind of a cosmetic to provide color and texture to a lip of a user. In general, the lipstick is made from source materials, such as pigments, oil, waxes, and softeners. The lipstick is produced as a content having a solid or gel form while representing various colors and received in a lipstick case. In order to wear makeup, the user applies the lipsticks onto the lip of the user directly or by using an additional lip brush.

The lipstick, which is a daily necessity carried by most women, has been produced with excellent portability and convenience in outdoor use because the women apply the lipstick onto the lips outdoors in many cases although the women frequently use the lipstick at home.

According to a lipstick container of the related art described above, generally, a guide groove 3 is formed in one lateral side of a guide tube 2 fitted into a case body 1 as shown in FIG. 1, a lipstick holder 5 is inserted in such a manner that a protrusion 4 is placed in the guide groove 3, a spiral groove 7 is formed in an inner wall of a rotary tube 6, the rotary tube 6 is coupled to an outer portion of the guide tube 2 so that the protrusion 4 is fitted into the spiral groove 7, and a cap 8 is coupled to an upper portion, of the case body 1.

When a user put on lip makeup using the conventional lipstick container, the user grips the rotary tube 6 in one hand of the user and the case body 1 in the other hand of the user, and rotates the rotary tube 6 and the case body 1 in directions opposite to each other, so that the protrusion 4 of the lipstick holder 5 is guided and moved up along the spiral groove 7 of the rotary tube 6 and the guide groove 3 of the guide tube 2. At this time, even the lipstick inserted into the lipstick holder 5 is moved up together with the protrusion 4, so that the user can put on the lip makeup.

However, since the lipstick container according to the related art has a structure of converting rotational movement into linear movement, many components are required, and the cost of the products is increased due to the complex structure. In addition, the assembling time is significantly taken when the lipstick container is produced, so that the productivity may be degraded.

In addition, since a user grips the case body 1 in one hand of the user and the rotary tube 6 in the other hand of the user and rotates the case body 1 and the rotary tube 6, that is, uses both hands in order to use the conventional lipstick when the user gets ready for going out, the user may inconveniently put on makeup when using a hand mirror.

In order to solve the above problem, as shown in FIG. 2, a lipstick container is disclosed in Korean Utility Model Registration No. 20-0220242. According to the related art, a through hole 11 is formed in an upper portion of a case body 10, and an elastic sheet 13 having a bed shape is formed on one side wall of an internal tub body 12 received in the case body 10, the elastic sheet 13 is formed on an inner circumferential wall of the case body 10 and coupled by a guide step 15 fitted into the guide groove 14 and guided by the guide groove 14, an operating member 17, which is inserted into an elongated guide hole 16 formed in one main wall of the case body 1 and guided by the guide hole 16, is attached to an intermediate part of the elastic sheet 13, and an outer end portion of the elastic sheet 13 serves as a cover plate 18 so that a front end portion of the cover plate 18 is fitted and locked into a fitting groove 19 formed at one side of the through hole 11.

The related art relates to an automatic lipstick device in which the operating member 17 formed on one wall of the case body 1 is moved down along the elongated guide hole 16, so that the stopper 18 of the through hole 11 is open while the inner tub body 12 coupled to a lipstick ascends and protrudes out of the case body 10.

However, according to the related art, since the lipstick is pushed down when a user uses the lipstick, the use of the lipstick may be inconvenient. In addition, when the user moves up and down the lipstick by moving the operating member 17, the lipstick may not smoothly move up and down.

DISCLOSURE

Technical Problem

The present, invention is made in order to solve the above problem occurring in the related art, and an object of the present invention is to provide a slide-type lipstick container in which a button and a button guide slit, into which the button is fitted, are formed in an outer circumferential surface of an external case, a slide member, which moves a lipstick up and down, is coupled to ribs of the button and a lower end of a lipstick holder, studs are formed at upper and lower portions of the button guide slit, and friction protrusions are formed on the ribs of the button so that the friction protrusions make friction with the button guide slit to control the vertical movement of the button, thereby preventing the lipstick from being pushed down when the lipstick container is used and allowing the lipstick container to smoothly operate when the lipstick container operates.

Technical Solution

According to the present invention, there is provided a slide-type lipstick container including an external case formed in an outer circumferential surface thereof with a button guide slit, an internal case mounted in the external case and formed in an inside thereof with a guide groove, a slide member mounted in the guide groove of the internal case and formed at both ends thereof with a rib mounting groove and a coupling protrusion, a button coupled to the rib mounting groove of the slide member and having ribs, a lipstick holder coupled to the coupling protrusion of the slide member, and a guide tube coupled to the external case.

The slide member includes an elastic sheet having a thin plate shape to be vertically movable along the guide groove of the internal case, and the ribs of the button are paired, an elastic space is formed between the paired ribs, and friction protrusions are formed on lateral sides of the ribs.

In addition, a stud is formed in the button guide slit of the external case.

Further, the lipstick holder is formed at a lower end thereof with a coupling groove.

Advantageous Effects

As described above, according to the slide-type lipstick container of the present invention, the button and the button guide slit, into which the button is fitted, are formed in the outer circumferential surface of the external case, the slide member, which moves the lipstick up and down, is coupled to the ribs of the button and the lower end of the lipstick holder, the studs are formed at the upper and lower portions of the button guide slit, and the friction protrusions are formed on the ribs of the button so that the friction protrusions make friction with the button guide slit to control the vertical movement of the button, thereby preventing the lipstick from being pushed down when the lipstick container is used and allowing the lipstick container to smoothly operate when the lipstick container operates.

BEST MODE

Mode for Invention

Hereinafter, a slide-type lipstick container according to one embodiment of the present invention will be described with, reference to accompanying drawings.

Figure 1:
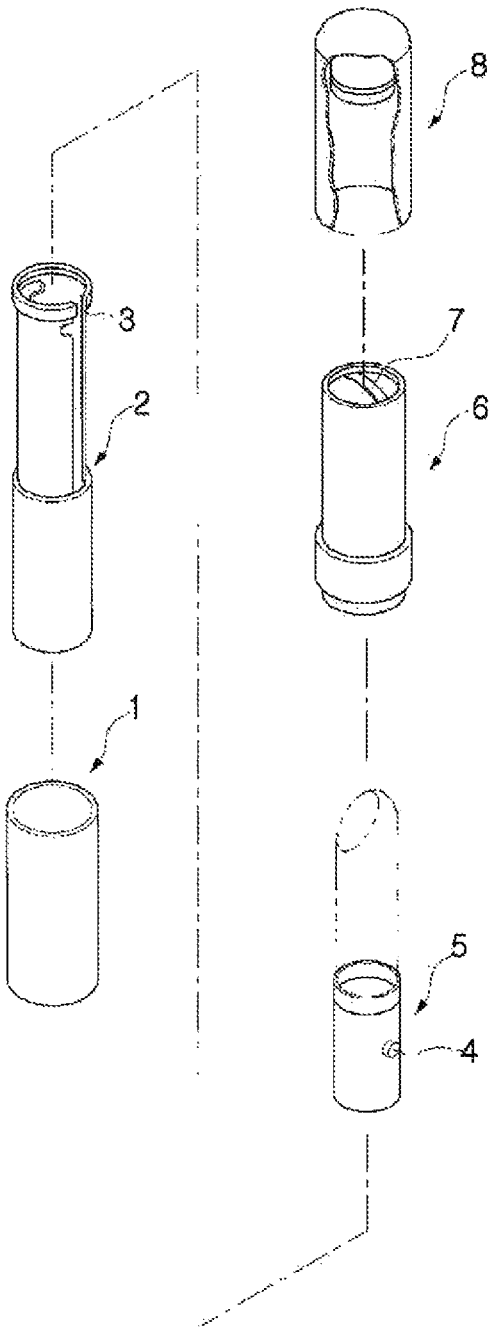
FIG. 1 is an exploded perspective view showing a lipstick container according to the related art.
Figure 2:
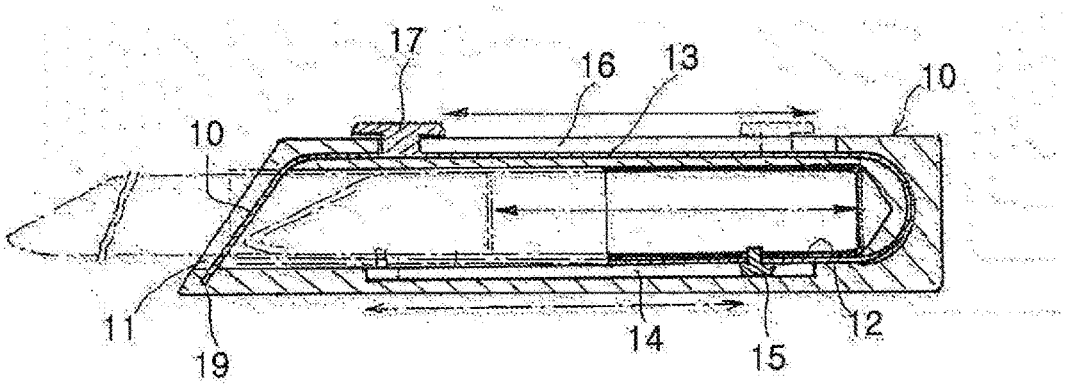
FIG. 2 is a sectional view showing the lipstick container according to the related art.
Figure 3:
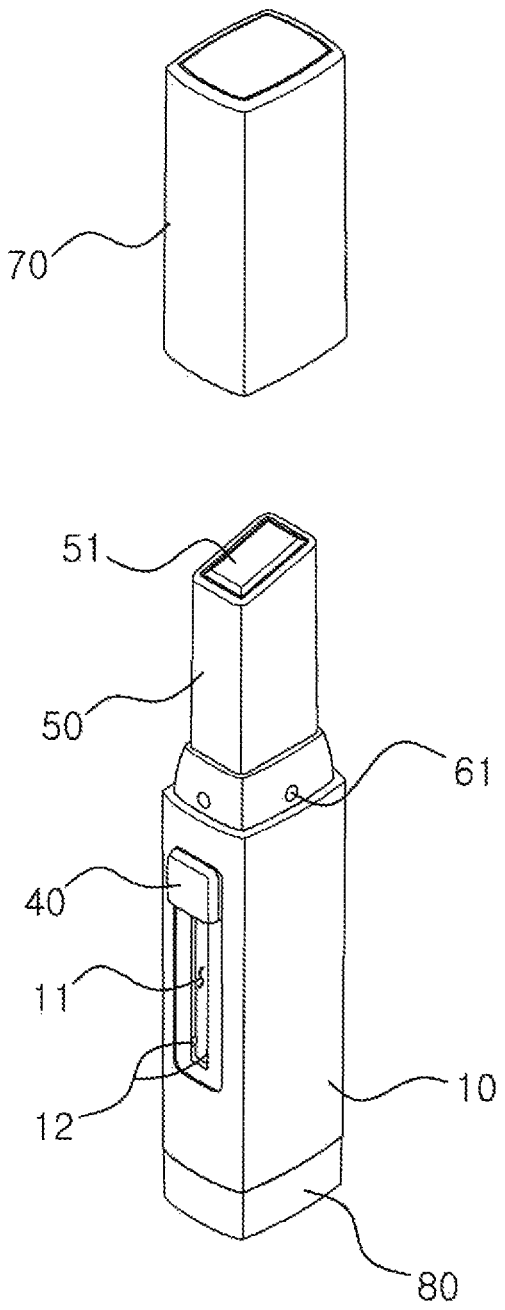
FIG. 3 is a perspective view showing a slide-type lipstick container when a cap is uncovered from the slide-type lipstick container according to one embodiment of the present invention.
Figure 4:
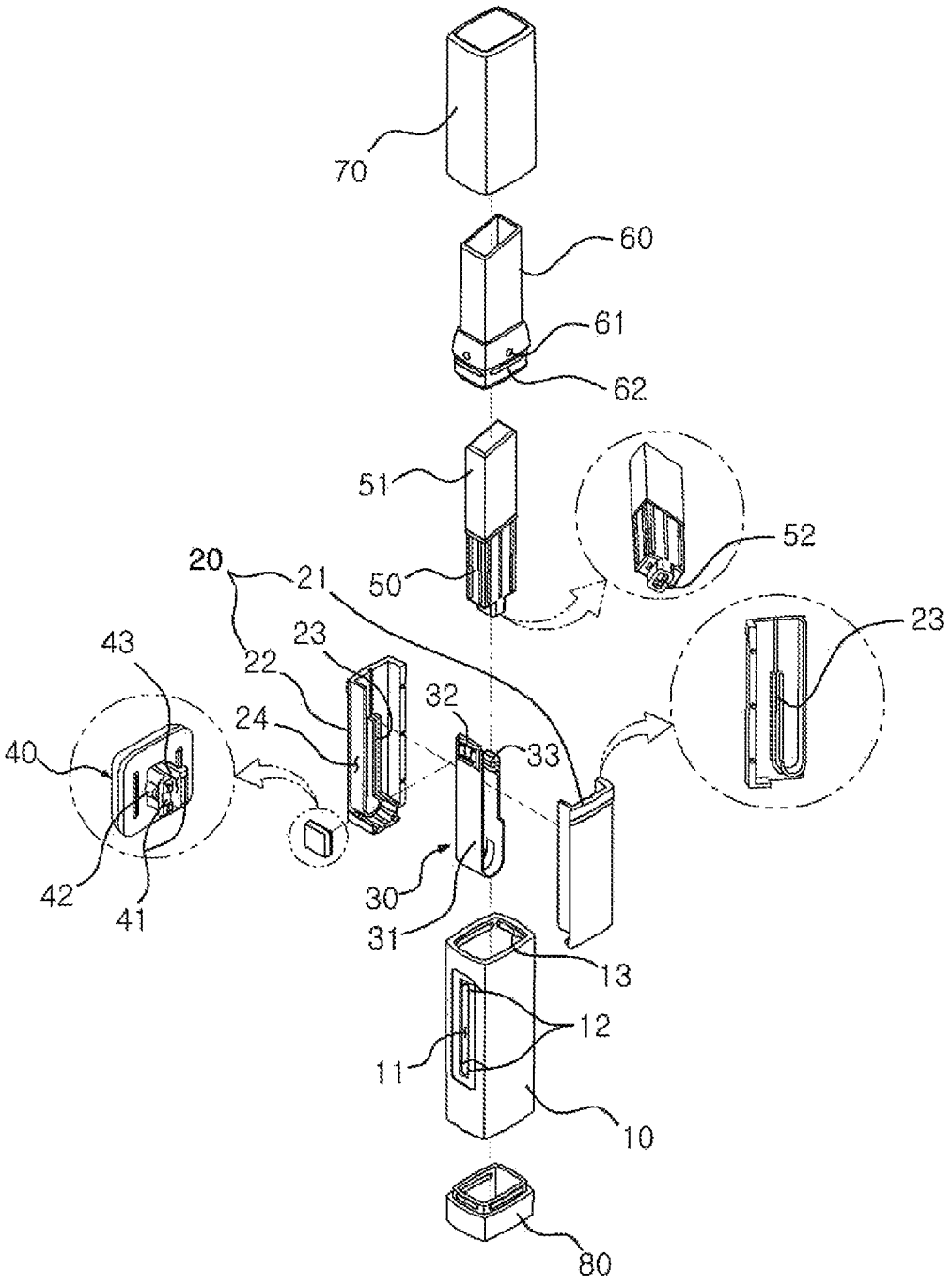
FIG. 4 is an exploded perspective view showing a slide-type lipstick container according to one embodiment of the present invention.
Figure 5:
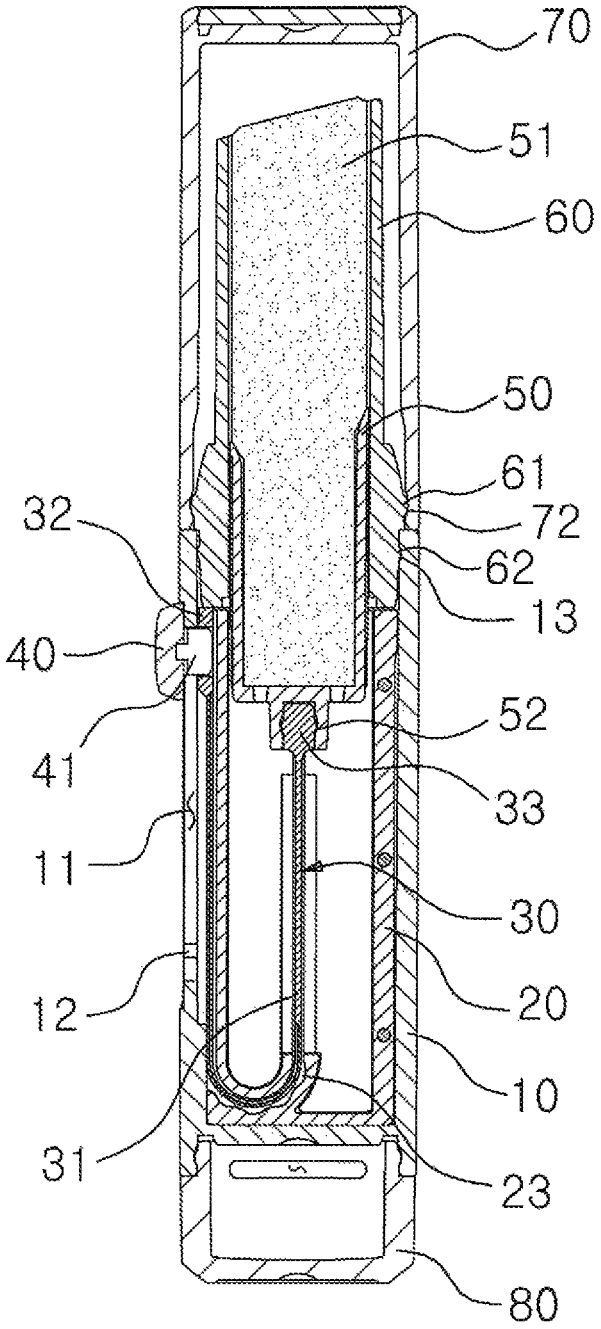
FIG. 5 is a sectional view showing the slide-type lipstick container according to one embodiment of the present invention.
Figure 6:
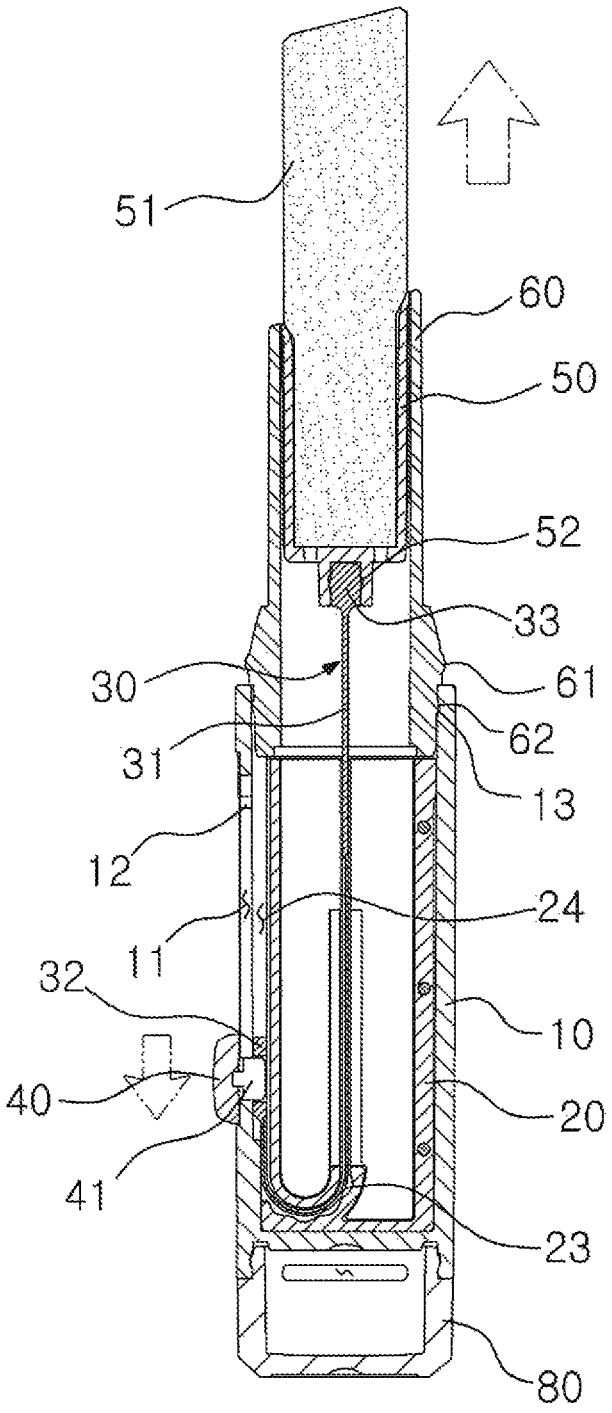
FIG. 6 is a sectional view showing a lipstick raised from the slide-type lipstick container according to one embodiment of the present invention.
Figure 7:
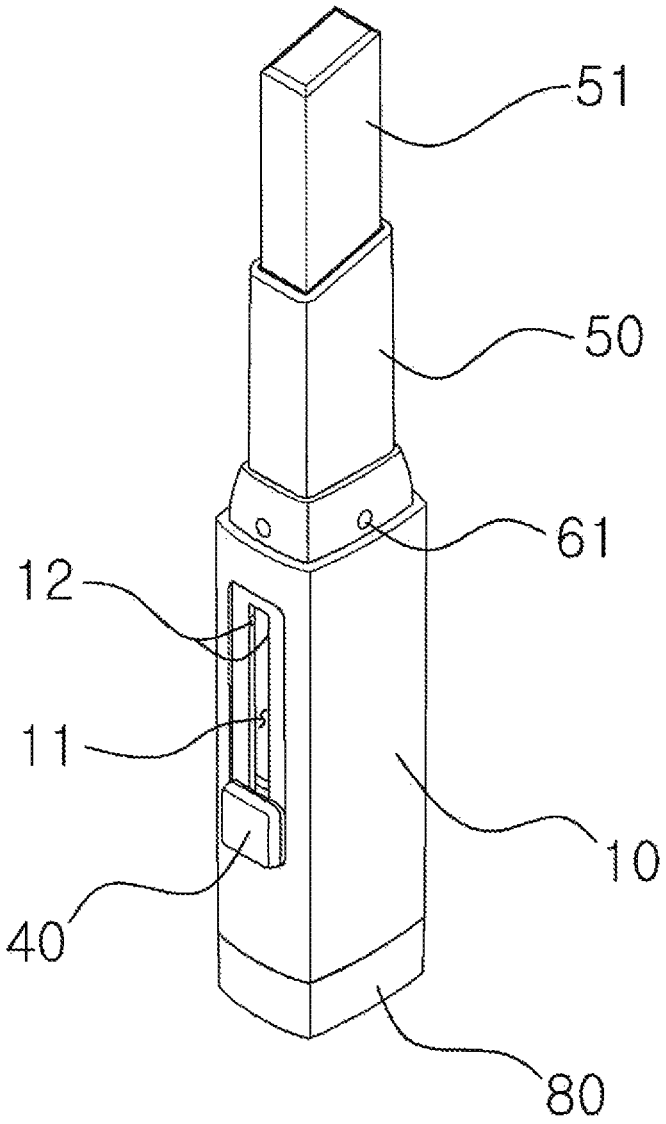
FIG. 7 is a perspective view showing the lipstick raised from the slide-type lipstick container according to one embodiment of the present invention.

FIG. 3 is a perspective view showing a slide-type lipstick container when a cap is uncovered from the slide-type lipstick container according to one embodiment of the present invention. FIG. 4 is an exploded perspective view showing a slide-type lipstick container according to one embodiment of the present invention. FIG. 5 is a sectional view showing the slide-type lipstick container according to one embodiment of the present invention. FIG. 6 is a sectional view showing a lipstick raised from the slide-type lipstick container according to one embodiment of the present invention. FIG. 7 is a perspective view showing the lipstick raised from the slide-type lipstick container according to one embodiment of the present invention.

The slide-type lipstick container according to one embodiment of the present invention includes an external case 10 formed in an outer circumferential surface thereof with a button guide slit 11, an internal case 20 mounted in the external case 10 and provided in an inside thereof with a guide groove 23, a slide member 30 mounted in the guide groove 23 of the internal case 20 and formed at both ends thereof with a rib mounting groove 32 and a coupling protrusion 33, a button 40 coupled to the rib mounting groove 32 of the slide member 30 and having ribs 41, a lipstick holder 50 coupled to the coupling protrusion 33 of the slide member 30, and a guide tube 60 coupled to the external case 10. The slide member 30 includes an elastic sheet 31 having a thin plate shape to be movable up and down along the guide groove 23 of the internal case 20. The ribs 41 of the button 40 are paired, an elastic space 43 is formed between the paired ribs 41, and friction protrusions 42 are formed on lateral sides of the ribs 41.

The external case 10 is formed in the outer circumferential surface thereof with the button guide slit 11, studs 12 are formed in the button guide slit 11, and a coupling groove 13 is formed in an upper inner circumferential surface of the external case 10.

The button, guide slit 11 vertically extends along the outer circumferential surface of the external case 10, and the button 40 is fitted into the button guide slit 11 so that the button 40 moves up and down.

The studs 12 are formed at upper and lower portions of the button guide slit 11 to prevent the button 40 from freely moving along the button guide slit 11.

According to the present invention, although the studs 12 are formed at the upper and lower portions of the button guide slit 11, more many studs 12 may be formed at the button guide slit 11 while being spaced apart from each other at a predetermined interval.

The coupling groove 13 is formed in the upper inner circumferential surface of the external case 10, and the guide tube 60 is fitted into the coupling groove 13.

In addition, a lower case 80 may be additionally coupled to a bottom of the external, case 10.

The internal case 20 includes a first internal case 21 and a second internal case 22 that are vertically separated from each other.

The first and second internal cases 21 and 22 are formed therein with guide grooves 23 and elastic sheet mounting spaces 24 defined by lateral sides of the first and second internal cases 21 and 22.

The first and second internal cases 21 and 22 are coupled to each other and fitted into the external case 10.

The guide grooves 23 are formed inside the first and second internal cases 21 and 22, so that the elastic sheet 31 of the slide member 30 is mounted in the guide grooves 23. In this case, the elastic sheet 31 is bent in a U shape, and a half of the U-shaped elastic sheet 31 is mounted in the guide grooves 23 to move up and down.

The elastic sheet 31 of the slide member 30 is positioned in the elastic sheet mounting space 24 defined by the lateral sides of the first and second internal cases 21 and 22. The elastic sheet 31 is bent in the U shape, and a portion other than a portion of the elastic sheet 31 mounted in the guide groove 23 is positioned in the elastic sheet mounting space 24. In other words, a portion of the elastic sheet 31 is positioned in the guide groove 23, and a remaining portion of the elastic sheet 31 is positioned in the elastic sheet mounting space 24. In this state, the elastic sheet 31 moves up and down.

In other words, if the elastic sheet 31 positioned in the guide groove 23 ascends, the elastic sheet 31 positioned in the elastic sheet mounting space 24 descends. If the elastic sheet 31 positioned in the guide groove 23 descends, the elastic sheet 31 positioned in the elastic sheet mounting space 24 ascends.

The slide member 30 includes an elastic sheet 31 having a thin plate shape, and is formed at both ends thereof with the rib mounting groove 32 and the coupling protrusion 33.

The elastic sheet 31 is positioned in both of the guide groove 23 and the elastic sheet mounting space 24 of the internal case 20 to move up and down.

The rib mounting groove 32 is formed at an end of the elastic sheet 31 positioned in the elastic mounting space 24, and the rib 41 formed at the button 40 is coupled to the rib mounting groove 32.

The coupling protrusion 33 is formed at an opposite end of the elastic sheet 31 positioned in the guide groove 23, and fitted into a coupling groove 52 formed in a lower end of the lipstick holder 50.

The button 40 is coupled to the rib mounting groove 32 of the slide member 30 and has the ribs 41.

The ribs 41 are paired, the elastic space 43 is formed between the paired ribs 41, and the friction protrusions 42 are formed on the lateral sides of the ribs 41.

The paired ribs 41 are coupled to the rib mounting groove 32 of the slide member 30 to couple the button 40 to the slide member 30.

When the button 40 is coupled to the slide member 30 so that the button 40 is positioned in the button guide slit 11, the friction protrusions 42 formed on the lateral sides of the paired ribs 41 are fitted into the button guide slit 11 to prevent the button 40 from freely moving.

The elastic space 43 is formed between the paired ribs 41 so that the ribs 41 is elastically moved when the ribs 41 pass the studs 12 formed at the button guide slit 11.

The lipstick holder 50 is coupled to a lipstick 51 representing various colors and shapes and provided in the lipstick holder 50, and formed in the lower end thereof with the coupling groove 52.

The coupling protrusion 33 of the slide member 30 is fitted into the coupling groove 52 so that the lipstick holder 50 moves up and down inside both of the internal case 20 and the guide tube 60 as the slide member 30 moves.

The guide tube 60 is formed in a tubular shape, and formed at a lower portion thereof with a first coupling protrusion 61 and a second coupling protrusion 62.

The guide tube SO guides the lipstick 51 when the lipstick holder 50 coupled to the lipstick 51 moves up and down The first, coupling protrusion 61 is coupled to a cap 70 to fixedly couple the cap 70 to the guide tube 60.

The second coupling protrusion 62 is coupled to the coupling groove 13 of the external case 10 to fixedly couple the guide tube 60 to the external case 10.

The cap 70 is formed in a lower inner circumferential surface thereof with a cap coupling groove 72, and the first coupling protrusion 61 of the guide tube 60 is fitted into the cap coupling groove 72.

The cap 70 is fitted with the guide tube 60 to prevent the lipstick 51 coupled to the lipstick holder 50 positioned in the guide tube 60 from being exposed to the outside, thereby preventing the lipstick 51 from being contaminated.

Hereinafter, an assembling method and a use state of the slide-type lipstick container according to one embodiment of the present invention will be described.

In order to assemble the slide-type lipstick container according to the present invention, the internal case 20 including the first and second internal cases 21 and 22 is assembled, and the slide member 30 including the elastic sheet 31 having a plate shape is mounted in the guide groove 23 and the elastic sheet mounting space 24.

The internal case 20 having the slide member 30 mounted therein is inserted into the external case 10 and coupled to the external case 10.

Thereafter, the ribs 41 of the button 40 are coupled to the rib mounting groove 32 formed in one side of the elastic sheet 31 of the slide member 30. In this case, the ribs 41 of the button 40 are coupled to the rib mounting groove 32 after passing through the button guide slit 11 of the external case 10.

Then, the coupling protrusion 33 formed at an opposite side of the slide member 30 is fitted into the coupling groove 52 of the lipstick, holder 50 coupled to the lipstick 51. Thereafter, the guide tube 60 having the tubular shape is fitted around an outer circumferential surface of the lipstick holder 50, and coupled to the external case 10.

In addition, the cap 70 is coupled to the first coupling protrusion 61 of the guide tube 60 to prevent the lipstick 51 from being exposed to the outside, and the assembling work is completed.

When the slide-type lipstick container assembled through the above method is used, the cap 70 is separated as shown in FIG. 3.

Thereafter, as shown in FIG. 6, the button 40 is moved down to expose the lipstick 51 coupled to the lipstick holder 50 to the outside.

In this case, the ribs 41 of the button 40 pass through the studs 12 formed at the button guide slit 11 of the external case 10.

The friction protrusions 42 are formed on the lateral sides of the ribs 41 of the button 40. When the friction protrusions 42 of the ribs 41 pass the studs 12, the ribs 41 elastically move due to the elastic space 43 formed between the ribs 41.

Thereafter, when the friction protrusions 42 formed on the lateral sides of the ribs 41 move on the button guide slit 11, the friction protrusions 42 prevent the lipstick 51 from being pushed and moved down. In addition, the friction protrusions 42 allow the lipstick container to smoothly operate when the lipstick container operates.

As the button 40 moves, the slide member 30 coupled to the button 40 moves together.

In addition, since the coupling protrusion 33 of the slide member 30 is fitted into the coupling groove 52 of the lipstick holder 50, the lipstick holder 50 coupled to the slide member 30 moves together with the button 40 when the button 40 moves.

Since the lipstick 51 is exposed to the outside as the button 40 moves up and down, the user can conveniently use the lipstick container according to the present invention. The friction protrusions 42 formed on the ribs 41 of the button 40 are fitted in the button guide slit 11 of the external case 10 to prevent the button 40 from freely moving.

Although a slide-type lipstick container according to one embodiment of the present invention has been described for illustrative purpose, the present invention is not limited thereto. Those skilled in the art will appreciate that various modifications, additions and substitutions are possible, without departing from the subject matter of the invention as disclosed in the accompanying claims.

The invention claimed is:

1. A slide-type lipstick container comprising:

an external case (10) formed in an outer circumferential surface thereof with a button guide slit (11);

an internal case (20) mounted in the external case (10) and formed in an inside thereof with a guide groove (23);

a slide member (30) mounted in the guide groove (23) of the internal case (20) and formed at both ends thereof with a rib mounting groove (32) and a coupling protrusion (33);

a button (40) coupled to the rib Mounting groove (32) of the slide member (30) and having ribs (41);

a lipstick holder (50) coupled to the coupling protrusion (33) of the slide member (30);

a guide tube (60) coupled to the external case (10), wherein the slide member (30) includes an elastic sheet (31) having a thin plate shape to be vertically movable along the guide groove (23) of the internal case (20), and the ribs (41) of the button (40) are paired, an elastic space (43) is formed between, the paired ribs (41), and friction protrusions (42) are formed on lateral sides of the ribs (41); and a stud (12) formed in the button guide slit (11) of the external case (10).

2. The slide-type lipstick container of claim 1, wherein the internal case (20) has an elastic sheet mounting space (24) defined by a lateral side of the internal case (20).

3. The slide-type lipstick container of claim 1, wherein the lipstick holder (50) is formed at a lower end thereof with a coupling groove (52).

* * * * *